US006552627B1

(12) United States Patent
Andoh et al.

(10) Patent No.: US 6,552,627 B1
(45) Date of Patent: Apr. 22, 2003

(54) DIELECTRIC FILTER, COMPOSITE DIELECTRIC FILTER, DIELECTRIC DUPLEXER, DIELECTRIC DIPLEXER, AND COMMUNICATION APPARATUS INCORPORATING THE SAME

(75) Inventors: Masamichi Andoh, Kyoto (JP); Norihiro Tanaka, Nagaokakyo (JP); Hidekazu Sasai, Uji (JP)

(73) Assignee: Murata Manufacturing Co. Ltd (JP)

( * ) Notice: Subject to any disclaimer, the term of this patent is extended or adjusted under 35 U.S.C. 154(b) by 0 days.

(21) Appl. No.: 09/705,182

(22) Filed: Nov. 2, 2000

(30) Foreign Application Priority Data

Nov. 2, 1999 (JP) ..... 11-313097

(51) Int. Cl.[7] ..... H01P 1/20; H01P 1/213; H01P 7/10

(52) U.S. Cl. ..... 333/134; 333/202; 333/219.1

(58) Field of Search ..... 333/134, 212, 333/202, 219.1

(56) References Cited

U.S. PATENT DOCUMENTS 4,480,238 A 10/1984 Iwasaki ..... 333/202
5,898,349 A * 4/1999 Hattori et al. ..... 333/202
6,094,113 A * 7/2000 Wenzel et al. ..... 333/202

FOREIGN PATENT DOCUMENTS

| | | |
|---|---|---|
| EP | 0817303 A2 | 1/1998 |
| JP | 8-88503 | 4/1996 |
| JP | 10-84201 | 3/1998 |

OTHER PUBLICATIONS

European Search Report dated Jan. 30, 2002.

* cited by examiner

*Primary Examiner*—Benny Lee
*Assistant Examiner*—Stephen E. Jones
(74) *Attorney, Agent, or Firm*—Dickstein, Shapiro, Morin & Oshinsky, LLP.

(57) ABSTRACT

A dielectric filter, a composite dielectric filter, a dielectric duplexer, a dielectric diplexer, and a communication apparatus, in which isolation between adjacent dielectric filters can be obtained, and deterioration of filter characteristics can thereby be prevented. A plurality of dielectric resonators formed by disposing dielectric cores in cavities, and coupling loops for coupling to predetermined resonance modes of the dielectric resonators, are combined to form a dielectric filter. The dielectric resonators and the coupling loops are arranged in such a manner that when the dielectric resonators of the dielectric filters are close to each other, the directions of the coupling portions of the adjacent coupling loops are substantially vertical to each other.

16 Claims, 7 Drawing Sheets

DIELECTRIC FILTER, COMPOSITE DIELECTRIC FILTER, DIELECTRIC DUPLEXER, DIELECTRIC DIPLEXER, AND COMMUNICATION APPARATUS INCORPORATING THE SAME

BACKGROUND OF THE INVENTION

1. Field of the Invention

The present invention relates to filters incorporating dielectric resonators, composite dielectric filters such as duplexers, and communication apparatus incorporating the same.

2. Description of the Related Art

Conventionally, for example, cellular base stations in mobile communication systems have used composite dielectric filters formed by a plurality of dielectric resonators, such as diplexers used for transmission and duplexers used for transmission and reception.

For example, Japanese Unexamined Patent Application Publication No. 10-75104 provides a dielectric filter formed by using a plurality of TM double-mode dielectric resonators. In this dielectric filter, the opening faces of the TM double-mode dielectric resonators are aligned flush with each other. A metal panel is disposed to cover the opening faces. In the panel, coupling loops are formed for inputting/outputting signals and performing coupling between the resonators. A plurality of the dielectric filters are arranged in parallel to each other to form a composite dielectric filter.

FIG. 8 shows a structural example of the composite dielectric filter according to the conventional art. In FIG. 8, the reference numerals 9 denote coaxial connectors for inputting the signals of three channels ch1, ch2, and ch3. The reference numeral 8 denotes a coaxial connector for outputting the three synthesized inputted signals. The reference characters R1*a* to R3*c* are TM double-mode dielectric resonators. These TM double-mode dielectric resonators serve as two-stage resonators by coupling between the resonance modes. In addition, coupling loops are used for performing the coupling between predetermined resonance modes of the adjacent dielectric resonators and performing the coupling between the predetermined resonance modes and the coaxial connectors. Specifically, a coupling loop 3*a* couples to one of the resonance modes of each of the resonators R1*a*, R2*a*, and R3*a*. A coupling loop 3*c* couples to one of the resonance modes of each of the resonators R1*c*, R2*c*, and R3*c*. In addition, a coupling loop 3*ab* performs coupling between the predetermined resonance modes of the resonators R1*a* and R1*b*, coupling between the predetermined resonance modes of the resonators R2*a* and R2*b*, and coupling between the predetermined resonance modes of the resonators R3*a* and R3*b*. Similarly, a coupling loop 3*bc* performs coupling between the predetermined resonance modes of the resonators R1*b* and R1*c*, coupling between the predetermined resonance modes of the resonators R2*b* and R2*c*, and coupling between the predetermined resonance modes of the resonators R3*b* and R3*c*. The above arrangement permits three dielectric filters F1, F2, and F3 to be constituted.

To adjust the characteristics of the dielectric filter, a cutting jig is inserted through adjusting holes disposed in the metal panel, and a predetermined part of a dielectric core is cut off.

However, in the composite dielectric filter according to the conventional, art as shown in FIG. 8, when the plurality of dielectric filters are arranged close to each other, the electric-fields of the coupling loops leaking from the adjusting holes are likely to easily couple to each other, whereby isolation between the adjacent filters is reduced, with the result that attenuation characteristics are deteriorated.

SUMMARY OF THE INVENTION

Accordingly, the present invention provides a dielectric filter, a composite dielectric filter, a dielectric duplexer, and a dielectric diplexer, in which isolation between adjacent filters can be obtained, and deterioration of filter characteristics can thereby be prevented. It is another object of the present invention to provide a communication apparatus incorporating one of the dielectric filter, the composite dielectric filter, the dielectric duplexer, and the dielectric diplexer.

According to a first aspect of the present invention, there is provided a composite dielectric filter including a plurality of dielectric filters, each of the dielectric filters including a dielectric resonator formed by disposing a dielectric core in a cavity, and a coupling loop for coupling to a predetermined resonance mode of the dielectric resonator. In the above composite dielectric filter, the respective dielectric resonators and coupling loops of the dielectric filters are arranged in such a manner that the directions of coupling portions of the adjacent coupling loops between the dielectric filters are substantially vertical to each other.

With this structure, even when the dielectric filters are close to each other, the adjacent coupling loops between the dielectric filters hardly couple to each other.

According to a second aspect of the present invention, there is provided a dielectric filter including a plurality of dielectric resonators formed by disposing dielectric cores in cavities, and coupling loops for coupling to predetermined resonance modes of the dielectric resonators. In this dielectric filter, the plurality of dielectric resonators are arranged in such a manner that an input signal flows in a first direction from a signal input portion, through a first series of resonators via respective coupling loops; then to a second series of resonators via a coupling loop; and then back to a signal output portion in a second direction which is opposite to the first direction, through the second series of resonators via respective coupling loops. In this arrangement of the dielectric resonators, a compact filter is obtained since the signal flows from input to output in two opposite directions, and further, the coupling loops are arranged in such a manner that the directions of coupling portions of the adjacent coupling loops are substantially vertical to each other.

With this arrangement, even in places where the dielectric resonators are adjacent to each other in the arrangement of the dielectric resonators, the coupling loops of the adjacent dielectric resonators hardly couple to each other.

According to a third aspect of the present invention, there is provided a dielectric duplexer including the composite dielectric filter or two dielectric filters that are the same as the above dielectric filter, a first-filter input port usable as a transmitted-signal input port, a second-filter output port usable as a received-signal output port, and an input/output port common to the first filter and the second filter used as an antenna port.

According to a fourth aspect of the present invention, there is provided a dielectric diplexer including the composite dielectric filter or a plurality of dielectric filters that is the same as the above dielectric filter, usable as a plurality of transmission filters for passing signals transmitted from predetermined frequency channels, and an output port common to the transmission filters usable as an antenna port.

According to a fifth aspect of the present invention, there is provided a communication apparatus including one of the composite dielectric filter, the dielectric filter, the dielectric duplexer, and the dielectric diplexer, which are described above.

Other features and advantages of the invention will be appreciated from the following detailed description of embodiments of the invention, in which like references denote like elements and parts.

DESCRIPTION OF EMBODIMENTS OF THE INVENTION

The structure of a dielectric diplexer according to a first embodiment of the present invention will be illustrated by referring to FIGS. 1 to 4.

Figure 1:
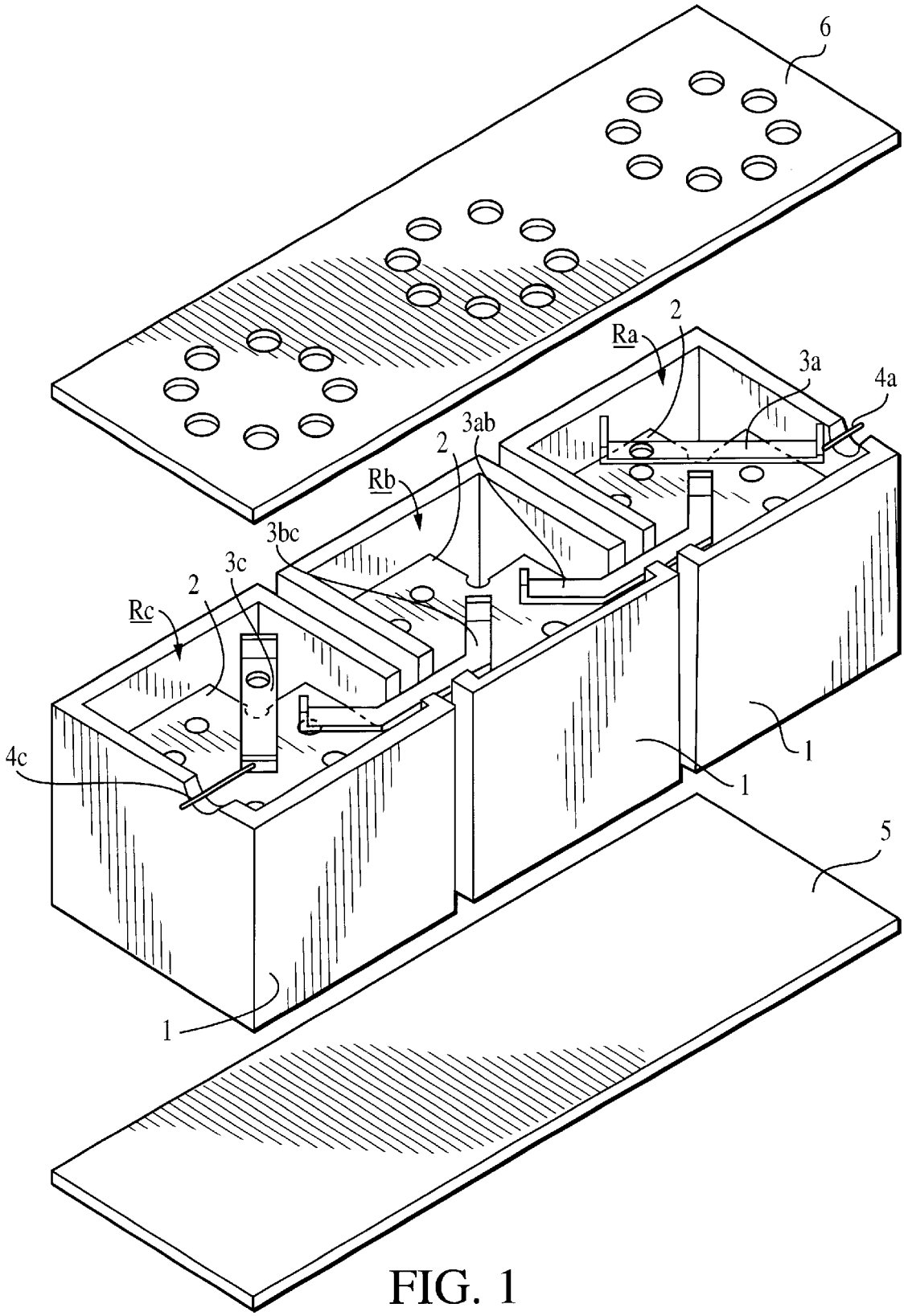
FIG. 1 is an exploded perspective view showing the structure of a dielectric filter of a dielectric diplexer according to a first embodiment of the present invention.

FIG. 1 is an exploded perspective view showing the structure of one of a plurality of dielectric filters forming the dielectric diplexer. In FIG. 1, the reference numeral 1 denotes each rectangular-prism-shaped cavity whose upper and lower surfaces are open. Inside the cavity 1, a cross-shaped dielectric core 2 is integrally formed with the cavity 1. On the outer surface of each cavity 1, a conductor film of a silver electrode or the like is formed. The reference numeral 5 denotes a lower cavity cover for covering the lower surface of the cavity 1, and the reference numeral 6 denotes an upper cavity cover for covering the upper part of the cavity 1. Both covers are formed of metal plates.

The reference characters Ra, Rb, and Rc denote dielectric resonators, each of which is formed by a cavity as a unit. As will be described below, each of the dielectric resonators Ra, Rb, and Rc forms a two-stage TM mode dielectric resonator.

Figure 4A:
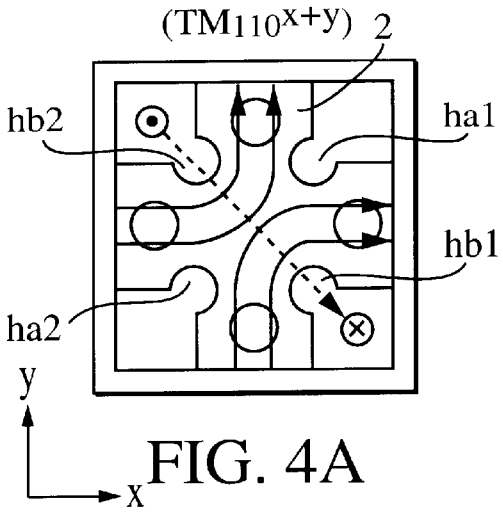
FIGS. 4A, 4B, 4C, and 4D show examples of the electric-field distributions of the resonance modes of the dielectric resonator used in the dielectric diplexer.
Figure 4C:
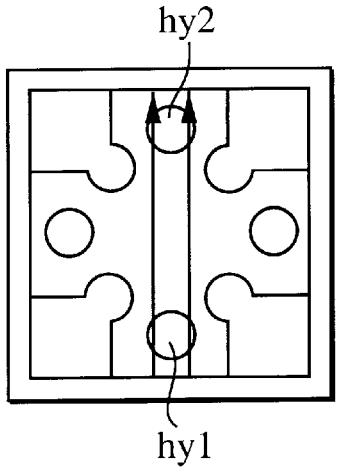
Figure 4B:
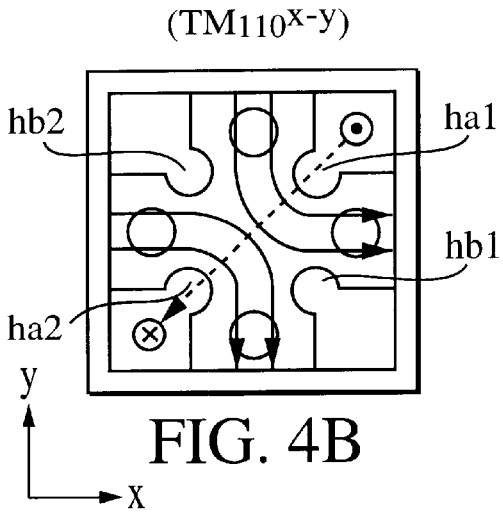
Figure 4D:
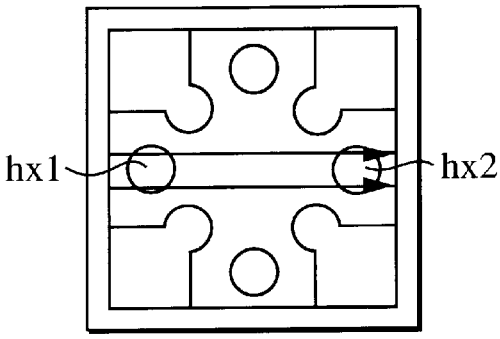

FIGS. 4A to 4D show examples of the electromagnetic distributions of the resonance modes of the dielectric resonator. In these figures, a solid-line arrow represents an electric-field vector, and a broken-line arrow represents a magnetic-field vector. Each of FIGS. 4A and 4B shows a fundamental mode used as a resonator. Since the mode shown in FIG. 4A is a mode whose electric field orients in an x+y direction, this mode is referred to as a $TM_{110}^{x+y}$ mode. Similarly, since the mode shown in FIG. 4B is a mode whose electric field orients in an x−y direction, this mode is referred to as a $TM_{110}^{x-y}$ mode. In addition, FIGS. 4C and 4D show coupling modes obtained when the above two modes are fundamental modes. FIG. 4C shows an odd mode, and FIG. 4D shows an even mode.

With the above relationship, with holes ha1, ha2, hb1, and hb2 disposed at corners of the cross-shaped dielectric core 2, by adjusting the sizes of the holes hb1 and hb2, the resonance frequency of the $TM_{110}^{x+y}$ mode can be adjusted. Similarly, by adjusting the sizes of the holes ha1 and ha2, the resonance frequency of the $TM_{110}^{x-y}$ mode can be adjusted. In addition, by adjusting the sizes of holes hy1 and hy2 disposed in the axial directions of two dielectric pillars, the frequencies of odd modes can be changed. By changing the sizes of holes hx1 and hx2, the even-mode resonance frequencies can be changed. With this arrangement, the coupling strength between the $TM_{110}^{x+y}$ mode and the $TM_{110}^{x-y}$ mode can be adjusted.

By cutting a predetermined hole of one of the dielectric cores via the holes disposed in the upper cavity cover 6 shown in FIG. 1, the resonance frequency of each stage and the coupling coefficient between the doubled resonators can be adjusted.

Figure 2:
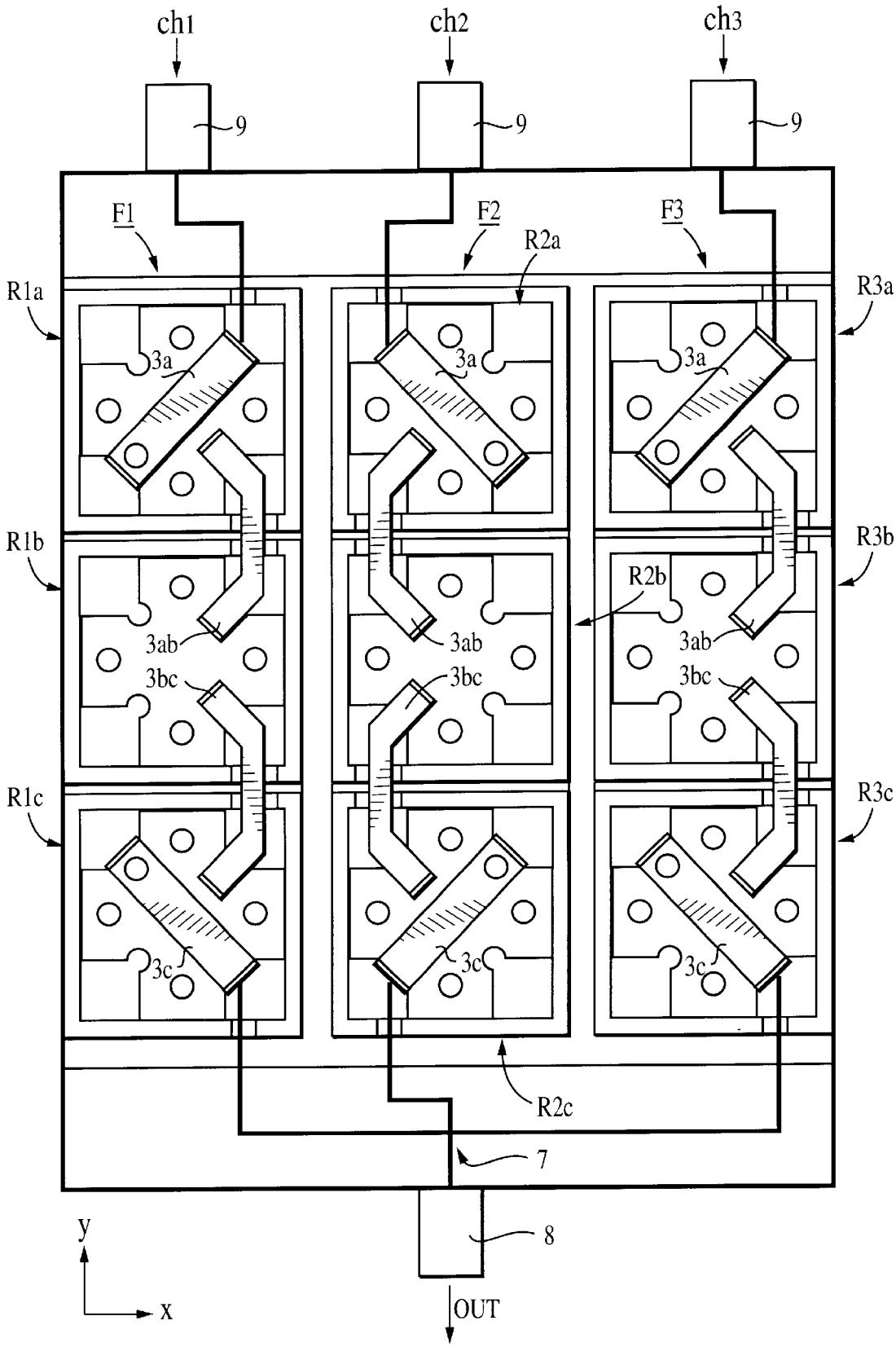
FIG. 2 is a top view of the dielectric diplexer in which the upper cavity cover of the diplexer is removed.
Figure 3:
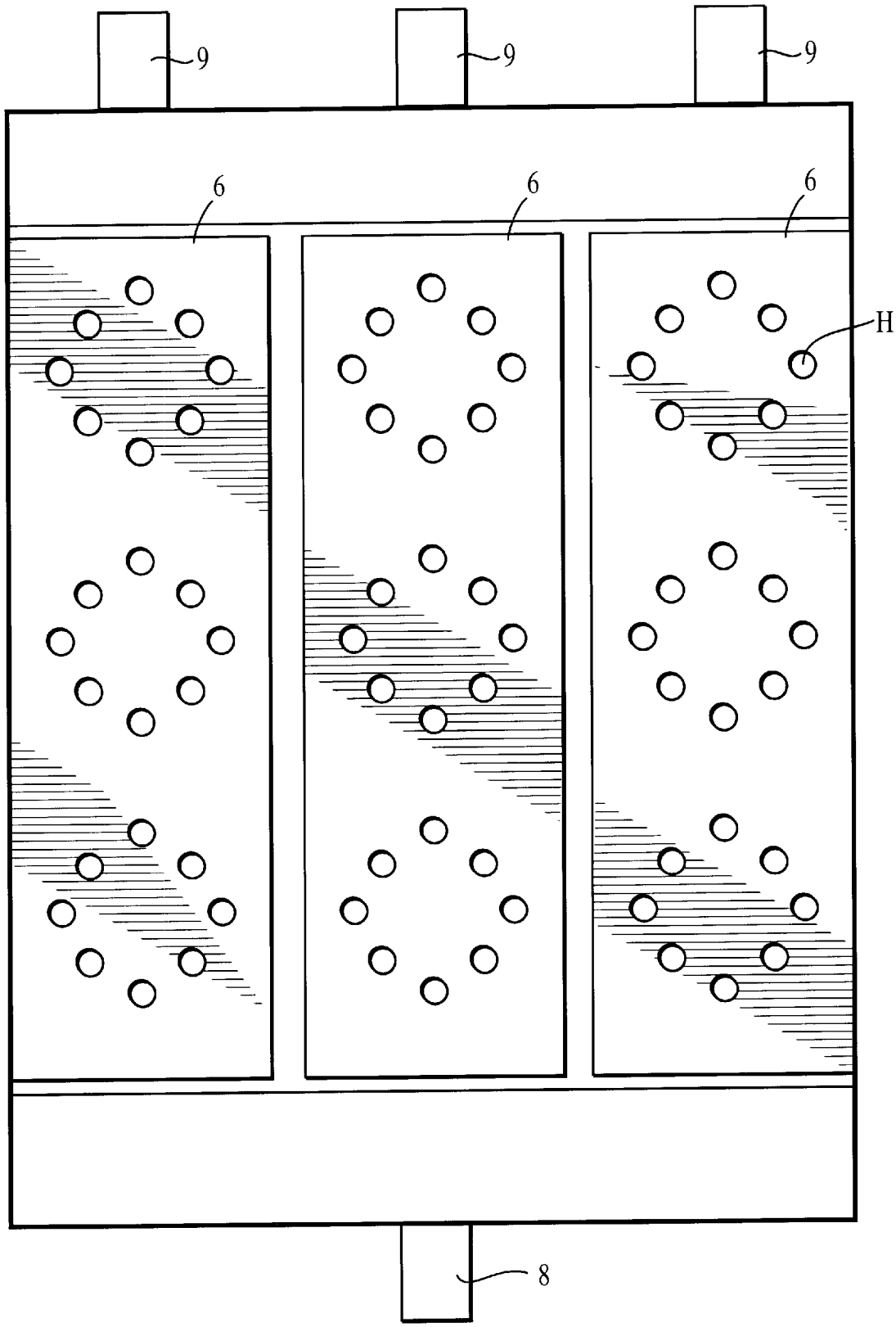
FIG. 3 is a top view of the dielectric diplexer showing the upper cavity cover of the diplexer.

FIG. 2 shows the top view of a dielectric diplexer formed by disposing three dielectric filters that are the same as the dielectric filter shown in FIG. 1, in which the upper cavity cover of the dielectric diplexer is removed. FIG. 3 shows the top view of the dielectric diplexer, in which the upper cavity cover thereof is not removed.

In each of FIGS. 2 and 3, each reference numeral 9 denotes a coaxial connector for inputting signals transmitted from one of three transmission channels ch1, ch2, and ch3, and the reference numeral 8 denotes a coaxial connector for outputting the synthesized signals to an antenna. The reference number 7 denotes a power synthesizer for power-synthesizing the signals transmitted from three transmission filters. A dielectric filter F1 constituted of three dielectric resonators R1*a*, R1*b*, and R1*c* serves as a transmission filter for the channel ch1. Similarly, a dielectric filter F2 constituted of three dielectric resonators R2*a*, R2*b*, and R2*c* serves as a transmission filter for the channel ch2. A dielectric filter F3 constituted of three dielectric resonators R3*a*, R3*b*, and R3*c* serves as a transmission filter for the channel ch3.

In the three transmission filters, the reference numeral 3*a* denotes a coupling loop connected to a central conductor of the coaxial connector 9, and the reference numeral 3*c* denotes a coupling loop connected to the power synthesizer 7. In addition, the reference numerals 3*ab* and 3*bc* denote coupling loops coupling to predetermined resonance modes of the adjacent dielectric resonators.

With the above arrangement, the coupling loop 3*a* of the dielectric filter F1 performs magnetic-field coupling to the $TM_{110}^{x+y}$ mode of the dielectric resonator R1*a*. The coupling loop 3*c* of the dielectric filter F1 performs magnetic-field coupling to the $TM_{110}^{x-y}$ mode of the dielectric resonator R1*c*. In addition, the coupling loop 3*ab* of the dielectric filter F1 performs magnetic-field coupling to the $TM_{110}^{x-y}$ mode of the dielectric resonator R1*a*, and, at the same time, performs magnetic-field coupling to the $TM_{110}^{x+y}$ mode of the dielectric resonator R1*b*. Furthermore, the coupling loop 3*bc* of the dielectric filter F1 performs magnetic-field coupling to the $TM_{110}^{x-y}$ mode of the dielectric resonator R1*b*, and, at the same time, performs magnetic-field coupling to the $TM_{110}^{x+y}$ mode of the dielectric resonator R1*c*. In this way, the dielectric filter F1 serves as a six-stage filter having band pass characteristics.

Similarly, the dielectric filters F2 and F3 also serve as band pass filters constituted of six resonator stages, respectively. In this case, between the dielectric filters F1 and F2, and between the dielectric filters F2 and F3, the adjacent coupling loops (for example the respective coupling loops 3*a* in filters F1 and F2, and/or the corresponding end portions of the corresponding coupling loops 3*ab*) are disposed in such a manner that the directions of coupling portions of the adjacent coupling loops are substantially vertical (perpendicular) to each other.

In order to adjust the characteristics of the dielectric filters, as shown in FIG. 3, predetermined parts of the dielectric cores inside the cavities are cut off via adjusting holes H disposed in the upper cavity cover 6.

With the above arrangement, the adjacent coupling loops of the adjacent dielectric filters have hardly any magnetic-field coupling therebetween, since the directions of the coupling portions of the coupling loops are vertical to each other. Thus, between the adjacent coupling loops, leakage and interference of signals hardly occur. That is, in FIG. 2, for example, the coupling loops 3*a* of the dielectric filters F1 and F2 do not perform magnetic-field coupling, since the directions of the loops are vertical to each other. In addition, the coupling loops 3*c* of the dielectric filters F1 and F2 do not perform magnetic-field coupling, since the directions of the loops are vertical to each other. Also, regarding the coupling loops 3*ab* of the dielectric filters F1 and F2, and regarding the coupling loops 3*bc* thereof, since the directions of the coupling portions of the adjacent loops (i.e., the angled portions at the respective ends of the portions that bridge between the resonators) are vertical to each other, the coupling loops 3*ab* and the coupling loops 3*bc*, respectively, do not perform magnetic-field coupling. These relationships also apply to the respective coupling loops of the dielectric filters F2 and F3. As a result, even when the dielectric filters are close to each other and the characteristics-adjusting holes in the cavity cover are open, the coupling loops of the mutually adjacent dielectric filters hardly perform magnetic-field coupling. Thus, leakage and interference of signals hardly occur.

Next, referring to FIG. 5, a description will be given of a dielectric duplexer according to a second embodiment of the present invention.

Figure 5:
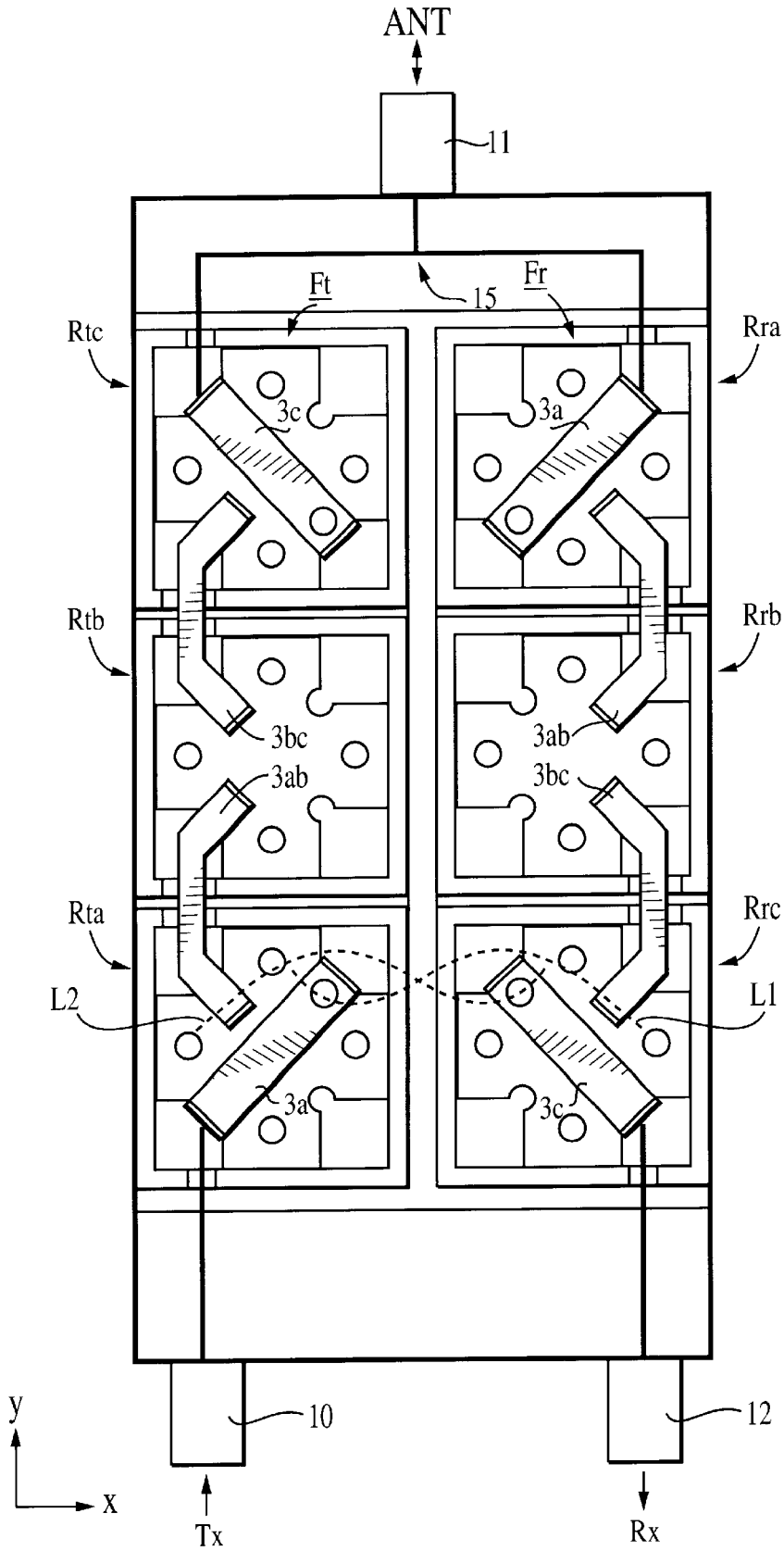
FIG. 5 shows the structure of a dielectric duplexer according to a second embodiment of the present invention.

FIG. 5 shows a top view of the dielectric duplexer, in which the upper cavity cover of the dielectric duplexer is removed. In FIG. 5, the reference numeral 10 denotes a coaxial connector for inputting a transmitted signal Tx, and the coaxial connector 10 is for being connected to a transmitter. The reference numeral 12 denotes a coaxial connector for outputting a received signal, and the coaxial connector 12 is for being connected to a reception circuit. The reference numeral 11 denotes a coaxial connector for outputting a transmitted signal and inputting a received signal, and the coaxial connector 11 is for being connected to an antenna. A part indicated by the reference numeral 15 constitutes a branching unit for branching transmitted/received signals. A dielectric filter Ft constituted of three dielectric resonators Rta, Rtb, and Rtc serves as a transmission filter. A dielectric filter Fr constituted of three dielectric resonators Rra, Rrb, and Rrc serves as a reception filter.

In the dielectric filter Ft, the reference numeral 3*a* denotes a coupling loop connected to a central conductor of the coaxial connector 10, and the reference numeral 3*c* denotes a coupling loop connected to the branching unit 15. In addition, the reference numerals 3*ab* and 3*bc* denote coupling loops for coupling to predetermined resonance modes of the adjacent dielectric resonators.

With the above arrangement, the coupling loop 3*a* of the dielectric filter Ft performs magnetic-field coupling to the $TM_{110}^{x+y}$ mode of the dielectric resonator Rta. The coupling loop 3*c* of the dielectric filter Ft performs magnetic-field coupling to the $TM_{110}^{x-y}$ mode of the dielectric resonator Rtc. The coupling loop 3*ab* of the dielectric filter Ft performs magnetic-field coupling to the $TM_{110}^{x-y}$ mode of the dielectric resonator Rta, and at the same time, performs magnetic-field coupling to the $TM_{110}^{x+y}$ mode of the dielectric resonator Rtb. In addition, the coupling loop 3*bc* of the dielectric filter Ft performs magnetic-field coupling to the $TM_{110}^{x-y}$ mode of the dielectric resonator Rtb, and at the same time, performs magnetic-field coupling to the $TM_{110}^{x+y}$ mode of the dielectric resonator Rtc. In this way, the dielectric filter Ft serves as a filter having band pass characteristics constituted of a six resonator stages.

Similarly, the dielectric filter Fr serves as a filter having band pass characteristics formed of six resonator stages.

In this case, between the respective resonators in each of the dielectric filters Ft and Fr, coupling loops are disposed in such a manner that the directions of the coupling portions of the adjacent coupling loops are substantially vertical to each other.

In order to adjust the characteristics of the dielectric filters, as in the case of the first embodiment, predetermined parts of the dielectric cores inside the cavities are cut off via the adjusting holes H disposed in the upper cavity cover.

With the above arrangement, the adjacent coupling loops hardly perform magnetic-field coupling therebetween, since the directions of the loops are vertical to each other. Thus, leakage and interference of signals hardly occur.

As indicated by a broken line L1 in FIG. 5, since the direction of the coupling loop 3*a* of the dielectric filter Ft and the direction of a coupling part of the coupling loop 3*bc* of the dielectric filter Fr are in a parallel relationship, the magnetic-fields of both loops leaking from the adjusting holes perform coupling therebetween. However, the resonator of $TM_{110}^{x+y}$ mode as the resonance mode of the dielectric resonator Rrc coupling to the coupling loop 3*bc* is not the last-stage resonator of the reception filter. The $TM_{110}^{x-y}$ mode resonator coupling to the coupling loop 3*c* of the dielectric filter Fr is the last-stage resonator. Thus, with the last-stage resonator, a transmitted signal leaking from the coupling loop 3*a* of the dielectric filter Ft to the coupling loop 3*bc* of the dielectric filter Fr is attenuated. As a result, the transmitted signal has no influence on the receiver. Similarly, as indicated by a broken line L2 in FIG. 5, since the direction of the coupling loop 3*c* of the dielectric filter Fr and the direction of a coupling part of the coupling loop 3*ab* of the dielectric filter Ft are also parallel, the leaking waves of both loops perform magnetic-field coupling to each other. However, since the amount of coupling is very little, there is almost no influence on the reception circuit.

Next, referring to FIG. 6, a description will be given of the structural example of a dielectric filter according to a third embodiment of the present invention.

Figure 6:
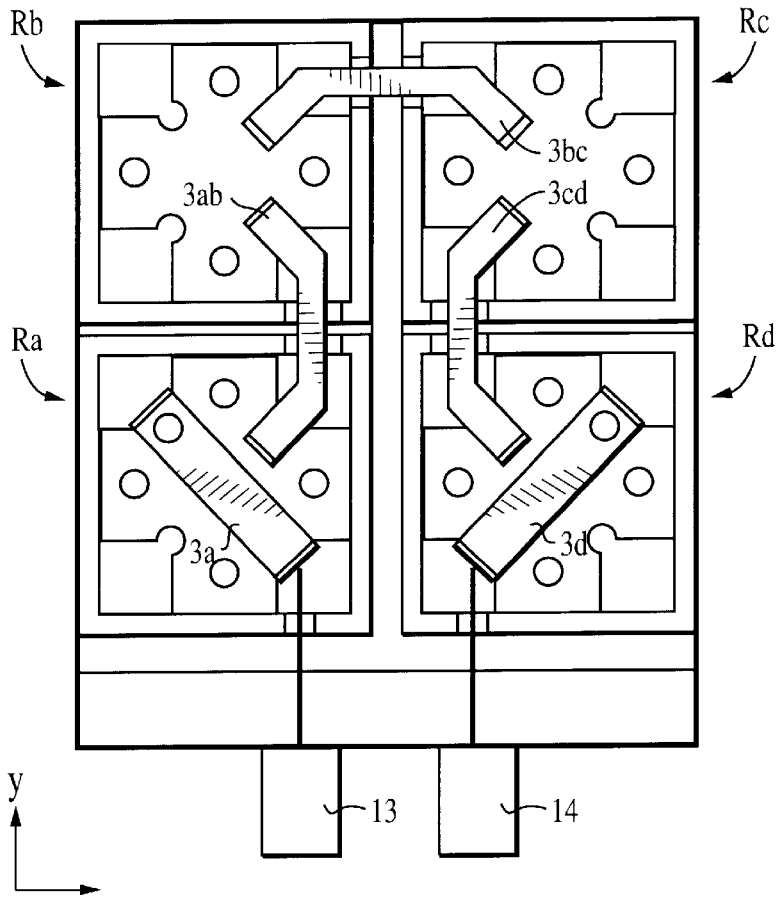
FIG. 6 shows the structure of a dielectric filter according to a third embodiment of the present invention.

FIG. 6 shows the top view of the dielectric filter in which the upper cavity cover of the filter is removed. In FIG. 6, the reference numeral 13 denotes a signal input coaxial connector, and the reference numeral 14 denotes a signal output coaxial connector. The reference characters Ra, Rb, Rc, and Rd denote TM double-mode dielectric resonators. The structures of these dielectric resonators are the same as those of the dielectric resonators used in the first and second embodiments.

The reference numeral 3*a* denotes a coupling loop connected to a central conductor of the coaxial connector 13. The reference numeral 3*d* denotes a coupling loop connected to a central conductor of the coaxial connector 14. In addition, the reference characters 3*ab*, 3*bc*, and 3*cd* denote coupling loops for coupling to predetermined resonance modes of the adjacent dielectric resonators.

The coupling loop 3*a* performs magnetic-field coupling to the $TM_{110}^{x-y}$ mode of the dielectric resonator Ra. The coupling loop 3*d* performs magnetic-field coupling to the $TM_{110}^{x+y}$ mode of the dielectric resonator Rd. The coupling loop 3*ab* performs magnetic-field coupling to the $TM_{110}^{x+y}$ mode of the dielectric resonator Ra, and at the same time, performs magnetic-field coupling to the $TM_{110}^{x-y}$ mode of the dielectric resonator Rb. In addition, the coupling loop 3*bc* performs magnetic-field coupling to the $TM_{110}^{x+y}$ mode of the dielectric resonator Rb, and at the same time, performs magnetic-field coupling to the $TM_{110}^{x-y}$ mode of the dielectric resonator Rc. The coupling loop 3*cd* performs magnetic-field coupling to the $TM_{110}^{x+y}$ mode of the dielectric resonator Rc, and, at the same time, performs magnetic-field coupling to the $TM_{110}^{x-y}$ mode of the dielectric resonator Rd. In this way, the dielectric filter serves as a filter having band pass characteristics constituted of eight resonator stages.

With the above arrangement, the adjacent coupling loops hardly perform magnetic-field coupling therebetween, since the directions of the coupling portions of the loops are vertical to each other. Thus, leakage and interference of signals hardly occur.

Next, referring to FIG. 7, a description will be given of the structural example of a communication apparatus according to the present invention.

Figure 7:
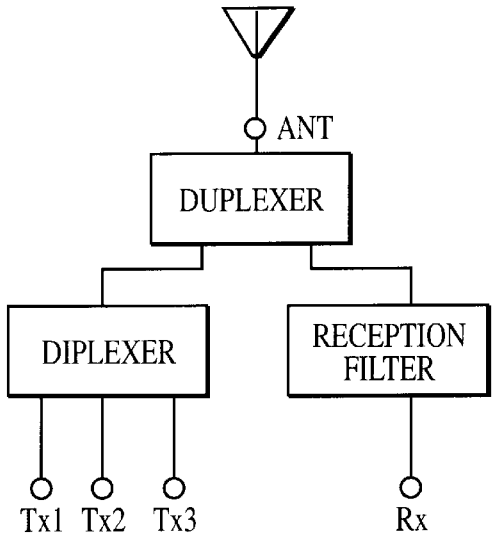
FIG. 7 shows the structure of a communication apparatus according to a fourth embodiment of the present invention.
Figure 8:
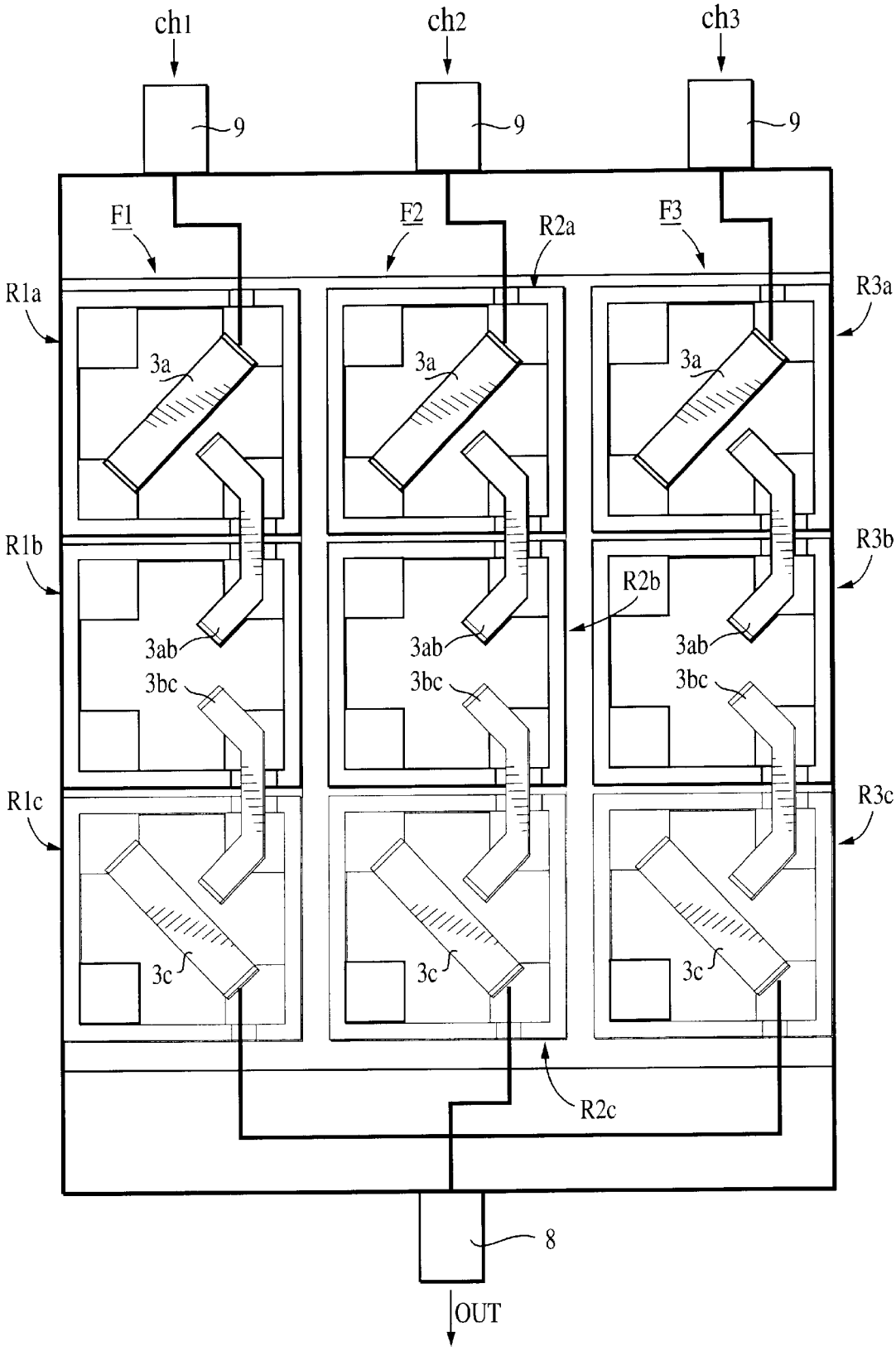
FIG. 8 PRIOR ART
FIG. 8 shows a view of the structural example of a conventional composite dielectric filter.

FIG. 7 shows a communication apparatus used in a base station in a cellular-type mobile communication system. A diplexer shown in FIG. 7 is equivalent to the dielectric diplexer shown in the first embodiment. As a duplexer, the dielectric duplexer shown in the second embodiment is used. Furthermore, as a reception filter, the dielectric filter shown in the third embodiment is used. The diplexer power-synthesizes transmitted signals Tx1, Tx2, and Tx3 of three channels output from the transmission circuit to supply a transmission signal to a transmitted signal input port of the duplexer. The duplexer outputs the transmitted signal to the antenna, and then supplies the signal received from the antenna to the reception filter. The reception filter supplies a signal Rx of a reception frequency band to the reception circuit.

As described above, according to the first and second aspects of the invention, even when the dielectric filters are close to each other, the coupling loops of the mutually adjacent dielectric filters hardly couple to each other. Thus, while reducing the size of the entire structure of the dielectric filter, isolation between the adjacent dielectric filters can be maintained. As a result, deterioration of filter characteristics can be prevented.

According to the third aspect of the invention, when the first filter as a transmission filter and the second filter as a reception filter are close to each other, since isolation can be maintained between the filters, the entire size of the dielectric duplexer can be reduced.

According to the fourth aspect of the invention, when handling signals in a plurality of channels, even when the filters are disposed closely to each other, since isolation therebetween can be secured, the entire size of the dielectric diplexer can be reduced.

According to the fifth aspect of the invention, since a compact dielectric filter and a compact composite dielectric filter having predetermined filter characteristics are used, the entire size of the communication apparatus can be reduced.

While embodiments of the present invention have been described above, it is to be understood that various modifications and changes will be made without departing from the scope and spirit of the invention.

What is claimed is:

1. A dielectric filter comprising:

at least first and second groups of dielectric resonators, said first group of resonators being mutually coupled to form a series of said resonators extending in a defined direction, said second group of resonators being mutually coupled to form a series of said resonators extending in said defined direction, each said resonator including a dielectric core disposed in a cavity and being associated with a pair of coupling loops, the first coupling loop along said defined direction having a first coupling portion, the second coupling loop along said defined direction having a second coupling portion, each of said coupling portions being disposed in said cavity for coupling to a predetermined resonance mode of the dielectric resonator, wherein:

a plurality of resonators in said first group of resonators are adjacent to a respective plurality of resonators in said second group of resonators, said first coupling portion in said resonator in said first group is substantially perpendicular to said first coupling portion in said resonator in said second group, and said second coupling portion in said resonator in said first group is substantially perpendicular to said second coupling portion in said resonator in said second group.

2. The dielectric filter according to claim 1, wherein all of said resonators in said first group of resonators are adjacent to respective resonators in said second group of resonators.

3. The dielectric filter according to claim 1, wherein each of said adjacent resonators have respective coupling portions which are perpendicular to one another.

4. A composite dielectric filter comprising:

at least first and second dielectric filters, said first dielectric filter comprising a group of resonators which are mutually coupled to form a series of said resonators extending in a defined direction, said second dielectric filter comprising a group of resonators which are mutually coupled to form a series of said resonators extending in said defined direction, each said resonator including a dielectric core disposed in a cavity and being associated with a pair of coupling loops, the first coupling loop along said defined direction having a first coupling portion, the second coupling loop along said defined direction having a second coupling portion, each of said coupling portions being disposed in said cavity for coupling to a predetermined resonance mode of the dielectric resonator, wherein:

a plurality of resonators in said first dielectric filter are adjacent to a respective plurality of resonators in said second dielectric filter, said first coupling portion in said resonator in said first filter is substantially perpendicular to said first coupling portion in said resonator in said second filter, and said second coupling portion in said resonator in said first filter is substantially perpendicular to said second coupling portion in said resonator in said second filter.

5. The composite dielectric filter according to claim 4, wherein each of said adjacent resonators have respective coupling portions which are perpendicular to one another.

6. A dielectric diplexer comprising:

a composite dielectric filter which includes at least first and second dielectric filters according to claim 4;

each said dielectric filter having a respective one of a plurality of predetermined frequency channels; and an output port connected in common to the filters for serving as an antenna port.

7. A communication apparatus comprising the dielectric diplexer according to claim 6, and a plurality of transmitting circuits connected respectively to said filters.

8. A dielectric duplexer comprising:

a composite dielectric filter which includes at least first and second dielectric filters according to claim 4;

an input port connected to said first filter for serving as a transmitted-signal input port;

an output port connected to said second filter for serving as a received-signal output port; and an input/output port connected in common to said first and second filters for serving as antenna port.

9. A communication apparatus comprising the dielectric duplexer according to claim 8, a transmitting circuit and a receiving circuit, said transmitting circuit being connected to said transmitted-signal input port, and said receiving circuit being connected to said received-signal output port.

10. The composite dielectric filter according to claim 4, wherein all of said resonators in said first dielectric filter are adjacent to respective resonators in said second dielectric filter.

11. A dielectric filter comprising:

at least first and second groups of dielectric resonators, said first group of resonators being mutually coupled to form a series of said resonators extending in a defined direction, said second group of resonators being mutually coupled to form a series of said resonators extending in said defined direction, each said resonator including a dielectric core disposed in a cavity and being associated with a pair of coupling loops, the first coupling loop along said defined direction having a first coupling portion, the second coupling loop along said defined direction having a second coupling portion, each of said coupling portions being disposed in said cavity for coupling to a predetermined resonance mode of the dielectric resonator, wherein:

a resonator in said first group of resonators is adjacent to a resonator in said second group of resonators, said first coupling portion in said resonator in said first group is substantially perpendicular to said first coupling portion in said resonator in said second group, and said second coupling portion in said resonator in said first group is substantially perpendicular to said second coupling portion in said resonator in said second group, and wherein:

said first and second groups of dielectric resonators are arranged so that a signal is received at a signal input portion connected to said first group, then flows through said first group in said defined direction, then flows through said second group in a direction opposite to said defined direction, and then reaches a signal output portion connected to said second group of dielectric resonators.

12. A dielectric duplexer comprising:

two dielectric filters according to claim 11;

a first-filter input port connected to one of said filters for serving as a transmitted-signal input port;

a second-filter output port connected to the other of said filters for serving as a received-signal output port; and an input/output port connected in common to the first filter and the second filter for serving as an antenna port.

13. A communication apparatus comprising the dielectric duplexer according to claim 12, a transmitting circuit and a receiving circuit, said transmitting circuit being connected to said transmitted-signal input port, and said receiving circuit being connected to said received-signal output port.

14. A dielectric diplexer comprising:

a plurality of dielectric filters according to claim 11, each filter having a respective one of a plurality of predetermined frequency channels; and an output port connected in common to the filters, for serving as an antenna port.

15. A communication apparatus comprising the dielectric diplexer according to claim 14, and a plurality of transmitting circuits connected respectively to said filters.

16. A communication apparatus comprising the composite dielectric filter according to claim 4 or the dielectric filter according to claim 11, and a high-frequency circuit comprising at least one of a transmitting circuit and a receiving circuit connected to said filter.

* * * * *